US009592623B2

(12) United States Patent
Frolov

(10) Patent No.: US 9,592,623 B2
(45) Date of Patent: Mar. 14, 2017

(54) RIP FENCE HAVING DUAL ADJUSTMENT FOR A POWER TOOL

(71) Applicants: Robert Bosch Tool Corporation, Broadview, IL (US); Robert Bosch GmbH, Stuttgart (DE)

(72) Inventor: Andrew Frolov, Glenview, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 328 days.

(21) Appl. No.: 13/727,252

(22) Filed: Dec. 26, 2012

(65) Prior Publication Data

US 2014/0174273 A1 Jun. 26, 2014

(51) Int. Cl.

| | |
|---|---|
| ***B27B 27/00*** | (2006.01) |
| ***B27B 27/08*** | (2006.01) |
| ***B27B 27/02*** | (2006.01) |
| ***B27B 27/10*** | (2006.01) |

(52) U.S. Cl.

CPC ..... *B27B 27/08* (2013.01); *B27B 27/00* (2013.01); *B27B 27/02* (2013.01); *B27B 27/10* (2013.01); *Y10T 83/727* (2015.04); *Y10T 83/73* (2015.04); *Y10T 83/739* (2015.04); *Y10T 83/7593* (2015.04)

(58) Field of Classification Search

CPC ..... B27B 27/02; B27B 27/10; B27B 27/00; Y10T 83/7593; Y10T 83/739; Y10T 83/727; Y10T 83/73; Y10T 83/00

USPC ..... 83/438, 446, 444, 477.1–477.2, 467.1

See application file for complete search history.

(56) References Cited

U.S. PATENT DOCUMENTS

| | | | | |
|---|---|---|---|---|
| 4,848,203 | A | 7/1989 | Brooks | |
| 5,078,373 | A * | 1/1992 | Miller | B27B 27/02 269/303 |
| 5,181,446 | A | 1/1993 | Theising | |
| 5,293,802 | A | 3/1994 | Shiotani et al. | |
| 5,353,515 | A | 10/1994 | Alvis et al. | |
| 5,775,749 | A * | 7/1998 | Reithmeyer et al. | 292/341.18 |
| 5,927,857 | A | 7/1999 | Ceroll et al. | |
| 6,062,121 | A | 5/2000 | Ceroll et al. | |
| 6,360,641 | B1 | 3/2002 | Talesky et al. | |
| 6,578,461 | B1 | 6/2003 | Loo | |
| 7,174,820 | B2 | 2/2007 | Huang | |
| 7,444,913 | B2 * | 11/2008 | Shibata et al. | 83/446 |

(Continued)

OTHER PUBLICATIONS

Bosch 4100 10-Inch Worksite Table Saw (Image), published at least as early as Dec. 25, 2012 (1 page).

(Continued)

*Primary Examiner* — Kenneth E. Peterson
*Assistant Examiner* — Nhat Chieu Do
(74) *Attorney, Agent, or Firm* — Maginot Moore & Beck LLP

(57) ABSTRACT

A guide assembly, or rip fence, supported by guides of a table saw includes a clamping apparatus having locking mechanisms located at each end of the guide assembly. Each of the locking mechanisms is independently adjustable to provide accurate and repeatable positioning of the guide assembly with respect to the table and with respect to the saw blade with self-alignment and desired force. An adjustable locking self-alignment spring provides for self-alignment of the rip fence with respect to the blade.

18 Claims, 5 Drawing Sheets

(56) References Cited

U.S. PATENT DOCUMENTS

| | | | | |
|---|---|---|---|---|
| 7,614,330 | B2 | 11/2009 | Griswold et al. | |
| 8,312,799 | B2 | 11/2012 | Frolov | |
| 2010/0122615 | A1 | 5/2010 | Janson | |
| 2011/0048201 | A1* | 3/2011 | Frolov | 83/446 |
| 2011/0061508 | A1 | 3/2011 | Scherl | |
| 2011/0067540 | A1 | 3/2011 | Frolov et al. | |
| 2013/0174705 | A1* | 7/2013 | Hendrickson | B27B 27/02 83/441.1 |

OTHER PUBLICATIONS

Bosch GTS1031 10" Worksite Table Saw (Image), published at least as early as Dec. 25, 2012 (1 page).
Dewalt DW745 10-Inch Compact Job-Site Table Saw with 16-Inch Max Rip Capacity (Image), published at least as early as Dec. 25, 2012 (1 page).
Hitachi C1ORB 10-Inch Portable Jobsite Table Saw with Stand (Image), published at least as early as Dec. 25, 2012 (1 page).
Makita 2704 Contractors 15 Amp 10-Inch Benchtop Table Saw (Image), published at least as early as Dec. 25, 2012 (1 page).

* cited by examiner

RIP FENCE HAVING DUAL ADJUSTMENT FOR A POWER TOOL

FIELD

The disclosure relates generally to power tools, and more particularly to material guides or fences for a saw device that accurately introduce material into and through a cutting instrument.

BACKGROUND

The typical saw device includes a cutting instrument, usually a saw blade, attached to a motor mounted beneath a work surface, commonly called a table. The table has an opening that allows a portion of the blade to extend through the table. To make a cut, a user places material on the table and directs the material through the rotating blade. To assist users in making accurate cuts, many table saws are adapted to receive fences or material guides.

One type of fence commonly found on table saws is the rip fence. The rip fence, also known as a guide assembly, is a table saw guide that assists users in making lengthwise cuts through material, as when cutting wood along the grain. Most rip fences traverse the table parallel to the cutting direction of the blade. In order to make cuts of varying width, a user slides the fence along the table closer to or farther away from the blade. To ensure an accurate cut is made, the fence should be securely fastened to the table.

A clamping system is commonly used to secure the rip fence to the table. The clamping system secures the fence to a guide located towards the front of the table and a guide located towards the rear of the table. The guides often extend perpendicularly to the cutting direction of the blade and traverse the entire width of the table. Previously known rip fence clamping systems utilize a rip fence that slides along the guides mounted at the front and the rear of the table. When the user places the fence in the desired position, the user engages a locking mechanism at the front which engages a locking mechanism at the rear that secures both ends of the rip fence to the table.

While clamping systems can adequately secure the fence to the table, some users find that the position of the rip fence can move when being clamped to the table. If the rip fence does move during clamping, the clamped location of the fence causes the material being cut to be cut along a line different than that intended by the user. The user believes that once the rip fence is clamped to the table, the clamping mechanism will pull the rip fence to the intended and desired location. But an alignment mechanism might not work if clamping at the rear end is adjusted incorrectly.

In view of the foregoing, it would be advantageous to provide a rip fence for a table saw where the rip fence provides for increased accuracy in cutting of material. It would also be advantageous if the rip fence could be easily secured to the table. Furthermore, it would be advantageous if the rip fence could be accurately located and clamped in the desired position without resorting to trial and error.

SUMMARY

In accordance with one embodiment of the present disclosure, there is provided a guide assembly for aligning a workpiece on a table of a table saw. The guide assembly includes an alignment member having a first end and a second end. The guide assembly also includes a first lock mechanism, located at the first end of the alignment member, to secure the first end to the table saw. The first lock mechanism is adjustable to apply a self-alignment feature. A second lock mechanism is located at the second end of the alignment member, to secure the second end to the table saw. The second lock mechanism is adjustable to apply an adjustable clamping force to the table saw. A linkage is operably coupled to the first lock mechanism and to the second lock mechanism, wherein movement of the first lock mechanism causes the linkage to move the second lock mechanism into engagement with the table saw to secure the second end to the table saw.

In another embodiment, a power saw includes a blade, a table having an opening configured to receive the blade, and an alignment member provided on the table. The alignment member includes a first lock mechanism located at a first end of the alignment member and a second lock mechanism located a second end of the alignment member. The first lock mechanism is adjustable to apply an adjustable self-alignment feature to the rip fence and the second lock mechanism is adjustable to apply an adjustable clamping force to the rip fence.

DESCRIPTION

Figure 1:
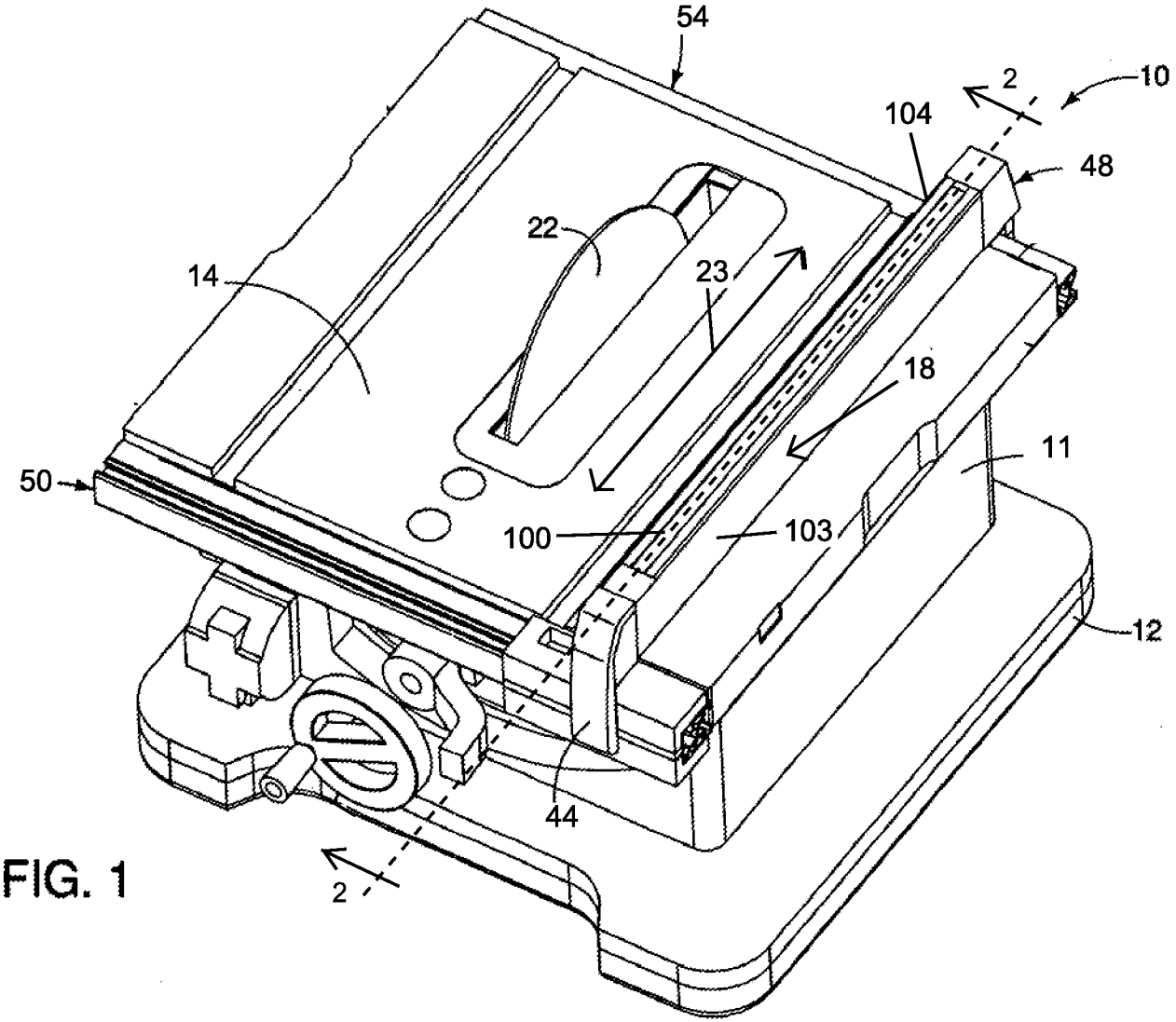
FIG. 1 is a perspective of a table saw including a rip fence.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

FIG. 1 is a perspective of a saw device 10 including a rip fence 18. The saw device may be, a table saw, a miter saw, a bevel saw, a compound saw, a vertical saw, a band saw, a jig saw, a machine saw, or any cutting device with a saw blade. A table saw 10 is illustrated herein. The table saw 10 includes a base 12 that supports an enclosure 11. The enclosure 11 houses an electric motor having a shaft upon which a cutting tool, usually a blade 22, is mounted for rotation. A planar surface, commonly referred to as a table 14, is secured to the top of the enclosure 11. The table 14 is usually constructed of a rigid and flat material such as metal, plastic, or fiberglass. The blade 22 projects through an opening in the surface of the table 14. A first fence guide 50 is located toward the front of the table 14 and a second fence guide 54 is located toward the back of the table 14. The fence guides 50 and 54 can be formed as part of the table 14 or can be separate parts each of which is coupled to the table 14 at the appropriate location.

The fence guides 50, 54, illustrated in perspective in FIG. 1, show generally the shape of such fence guides. In other embodiments, such as illustrated in sectional side views in FIGS. 2 and 3, the fence guides can include other configurations. The fence guides 50, 54 can traverse the width of the table 14 substantially perpendicular to a cutting direction 23 of the blade 22, where the material is moved from the front of the table to a back of the table.

The rip fence 18 includes a first lock mechanism 44 and a second lock mechanism 48 that are selectively moveable between a locked position and an unlocked position. When in the locked position, the first and second lock mechanisms 44, 48 engage the fence guides 50, 54 in such a manner that the fence 18 is becoming self-aligned prior to being secured to and fixed in place with respect to the blade 22 and table 14. When in the unlocked position, the first and second lock mechanisms 44, 48 disengage from the fence guides 50, 54 such that the rip fence 18 is free to slide along the table surface. The fence guides 50, 54 are constructed of a rigid material such as metal or plastic. The shape of the fence guides 50, 54 permits the rip fence 18 to be easily attached to and removed, and also permits the fence 18 to slide across the surface of the table 14 for positioning by an operator or user of the table saw 10.

Figure 2:
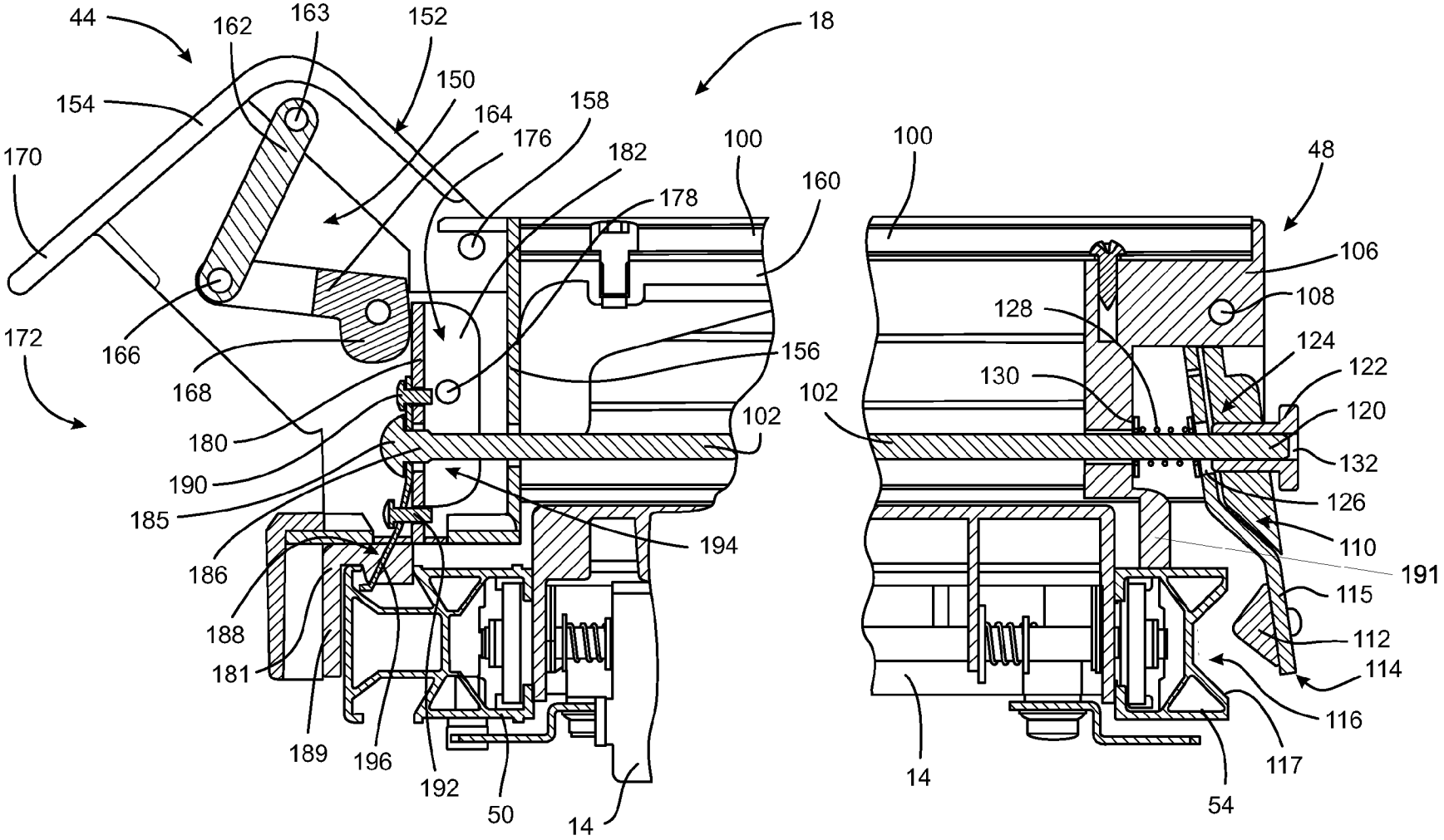
FIG. 2 is a sectional side view of the rip fence including a clamping assembly in an unclamped position taken along a line 2-2 of FIG. 1.

FIG. 2 is a sectional side view of the rip fence 18 including the first and second lock mechanisms 44 and 48 in an unclamped position taken along a line 2-2 of FIG. 1. As illustrated a guide 100, or alignment member, is used to guide material and couple the first lock mechanism 44 to the second lock mechanism 48. The guide 100 can be formed of a channel member or profile having an interior space to provide for a rod 102 operatively coupled to the first lock mechanism 44 and the second lock mechanism 48. The guide 100 also includes a side portions 103 and 104 each of which include a substantially planar guiding surface for a work piece. (See FIG. 1) Side portion 104 generally abuts the workpiece being cut by the blade 22. When the rip fence is accurately positioned with respect to the blade 22, the planar guiding surface of the side portion 104 is substantially parallel with the cutting direction 23 of the blade 22 to provide for precise cutting of material.

The second lock mechanism 48 is located towards the rear of the table during a cutting operation. The second lock mechanism 48 includes rear housing 106 which is coupled to the guide 100. Housing 106 includes a pivot pin 108 which supports a lock arm 110 for pivotal movement. The lock arm 110 includes a projection 112 coupled to an end 114 which engages a channel 116 defined in the second fence guide 54. The projection 112 and the channel 116 include a mating configuration such that engagement of the projection 112 with the channel 116 enables the second lock mechanism 48 to establish a locked position at the back portion of the rip fence 18 with respect to the table 14. In one embodiment, the projection 112 extends away from a planar portion 115 of the lock arm 110 and engages a recess 117 of the channel 116. When the rip fence 18 is locked in position, the projection 112 and the recess 117 form an interface. The projection 112 can be formed of a materials selected to increase the coefficient of friction at the interface with the recess 117 to substantially prevent slippage during cutting of a workpiece.

The lock arm 110 rotates about pivot pin 108 into and out of engagement with the channel 116. The projection 112 is pulled into engagement with the channel 116 by movement of the rod 102 responding to actuation of the first lock mechanism 44. The rod 102 includes an end 120 which includes threads (not shown) to engage mating threads (not shown) of an adjustment knob 122. The adjustment knob 122 can be rotated about the rod 102 to select the amount of force applied to the second guide 54 by the second lock mechanism 48 when the rip fence 18 is locked in place. Rotation of the knob 122 can either shorten or lengthen the effective actuating distance of rod 102 by determining how much of the end 120 extends past a middle portion 124 of the lock arm 110.

The adjustment knob 122 includes a dimension larger than an aperture 126 through which the rod 102 extends. Adjustment knob 122 is held generally fixed against the lock arm 110 by a biasing element, such as a spring 128, held in position on the rod 102 by a stop 130. The spring 128 is a helical spring surrounding the rod 102 and is compressed between the stop 130 and the middle portion 124 of the lock arm 110. By rotating the adjustment knob 122 about the rod 102, the amount of force applied to the channel 116 by the lock arm 110 can be selected. Other types of springs can also be used, such as a leaf spring. As illustrated in FIG. 2, the adjustment knob 122 includes a channel 132 which extends through the knob to provide for a larger range of locking forces to be applied between the projection 112 and the channel 116.

The first lock mechanism 44 is located towards the front of the table 14 for alignment of a rip fence for a desired cut of a workpiece. The first lock mechanism 44 includes a handle 150 rotationally coupled to a housing 152 via a pivot pin 158. The fixed portion 156 includes a cantilever portion 160 coupled to the guide 100 for support thereof. The fixed portion 156 is fixed with respect to the cantilever portion 160 and to the guide 100. A glide 181 is fixed to the housing 152 and provides a gliding surface for positioning the rip fence 18 on the first fence guide 50. A glide 191 is fixed to the housing 152 and provides a gliding surface for positioning the rip fence 18 on the second fence guide 54. When unlocked, rip fence 18 moves on the fence guides 50 and 54 on glides 181 and 191, but does not touch the table. During movement on the glides, the rip fence 18 is more or less parallel to the blade 22 where a gap is located between the fence 18 and the surface of the table 14.

Figure 3:
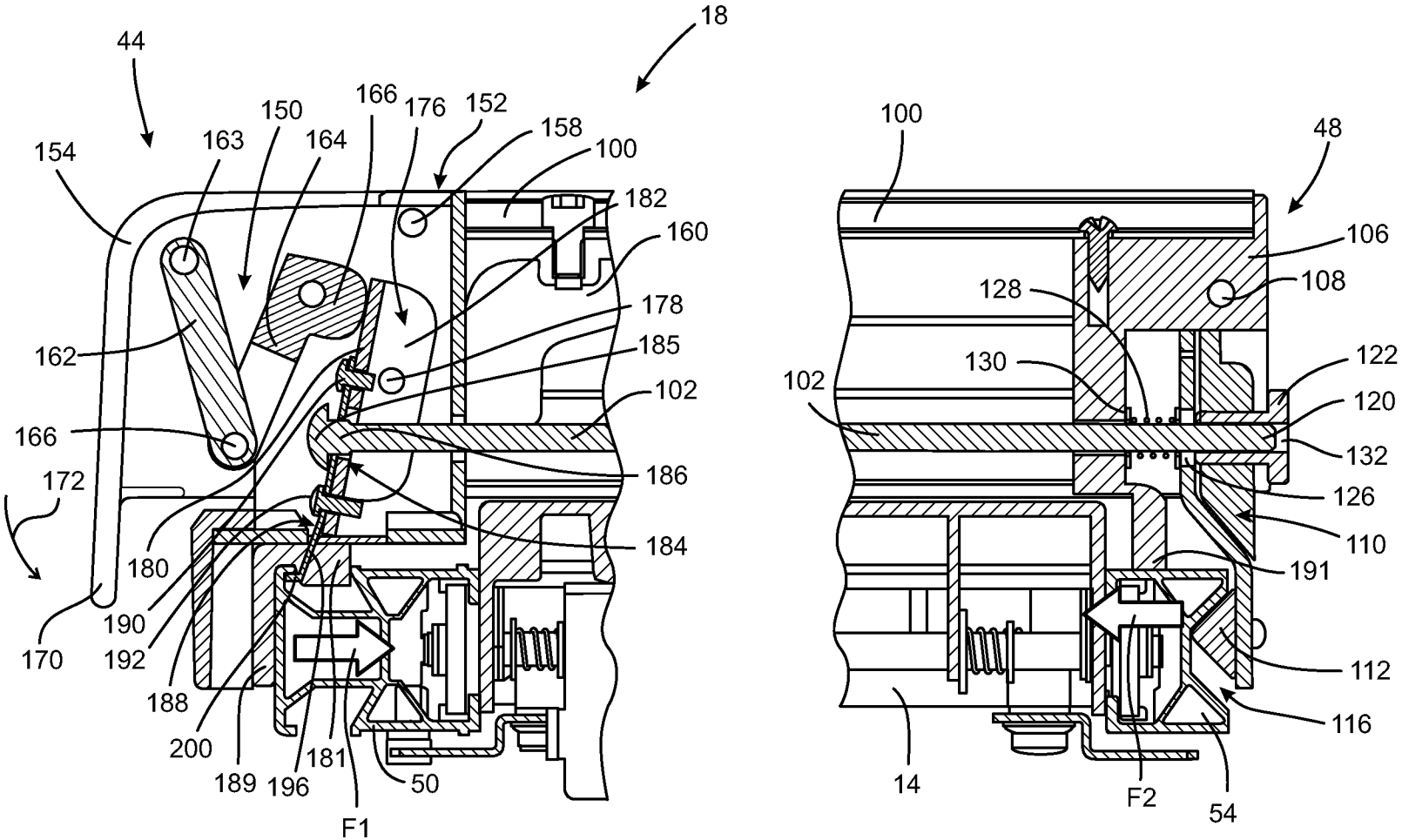
FIG. 3 is a sectional side view of the rip fence of FIG. 2 including a clamping assembly in a clamped position.

The handle 150 includes a link 162 having a first end pivotally coupled to a pivot pin 163 supported by a movable portion 154. A cam link 164 is coupled to a second end of the link 162 by a pivot pin 166 and a cam portion 168 is coupled to the activation member 176. The movable portion 154 also includes a lower portion 170 of the handle 150 to make it relatively easy to move the handle 150 from an extended unlocked position as shown in FIG. 2 to a retracted locked position as shown in FIG. 3.

The cam portion 168 engages an activation member 176. The activation member 176 is coupled to the fixed portion 156 of the housing 152 and is supported at and rotates about a pivot pin 178. The activation member 176 includes a flat portion 180 and a first side 182 and a second side (not shown) extending away from the flat portion 180 and substantially perpendicular thereto. The pivot pin 178 is coupled to the fixed portion at opposite sides and extends through the first side 182 and the second side. The activation member 176 includes an aperture 184 to accommodate a head 185 of the rod 102. The head 185 is sufficiently larger than the aperture 184 such that the head 185 cannot be pushed or pulled through the aperture 184. The rod 102 includes an anti-rotation portion 186 disposed adjacently to the head 185 which defines a substantially rectangular portion to engage the aperture 184, which includes a rectangular shape slightly larger than the anti-rotation portion 186. Any rotational force applied to the rod about a longitudinal axis is thereby prevented. Other mechanisms for preventing rotation are also possible including different interfaces between the anti-rotation portion 186 and the aperture 184 including, for instance, a keying configuration. In another embodiment, a pin can be inserted through the activation member 176 and the portion 186 to pivotally couple the end of the rod 102 to the activation member, which can obviate the need for the head 185.

A locking/self-alignment spring 188, or self-alignment biasing element, is coupled to the activation member 176 with an attachment screw 190 and an adjustment screw 192. The locking self-alignment spring 188, which is resilient, can be formed as part of the activation member 176, or the activation member can include an activation plate separable from the locking self-alignment spring 188. The attachment screw 190 passes through an aperture of the locking self-alignment spring 188 and engages a threaded aperture located in a top portion 194 of the activation member 176.(See FIGS.5 and 6) The attachment screw 190, when fully seated, fixes the location of the locking self-alignment spring 188 to the activation member 176. In other embodiments, the locking self-alignment spring 188 can be permanently coupled to the activation member including spot welding or adhesives. The adjustment screw 192, or positioner, is threaded through another aperture of the locking self-alignment spring and into a threaded aperture located in a bottom portion 196 of the locking self-alignment spring 188. The adjustment screw provides an adjustment feature to enable positioning of the locking self-alignment spring with respect to the first fence guide 50. In the unlocked position, the bottom portion 196 of the locking/self-alignment spring does not engage the first fence guide 50.

To secure the rip fence 18 to the fence guides 54 and 50, the rip fence 18 is placed at a desired location on the table 14. When the handle 150 is in the open position of FIG. 2, the guide 100 is placed at a position which is more or less parallel to the cutting direction 23 such that the lock arm 110 and the locking spring 188 can be moved into contacting positions with the respective fence guides 50 and 54. Once the rip fence 18 is positioned at the desired location, the handle 150 is moved in the direction 172 and rotates about the pivot pin 158. The handle 150 responsively moves towards the retracted state of FIG. 3. As the handle 150 moves towards the direction 172, the link 162 moves the cam link 164 to move the cam portion 168 into contact with the flat portion 180 of the activation member 176. Further movement of the handle 150 forces the cam portion 168 to rotate the activation member 176 about pivot pin 178 in a counterclockwise direction (as illustrated) such that the bottom portion 196 of the locking/self-alignment spring 188 moves toward the first fence guide 50.

As the locking/self-alignment spring 188 moves towards the first fence guide 50, the rod 102 is pulled towards the first fence guide 50 which moves the projection 112 of the lock arm 110 towards the channel 116. A further movement of the handle 150 moves the locking self-alignment spring 188 into engagement with a ledge 200, or lip, of the first fence guide 50. Once the locking self-alignment spring 188 engages the ledge 200, it provides a self-aligning feature by pushing the rip fence 18 toward towards the right (as illustrated) until a lower portion 189 of the glide 181 engages with a vertical portion of the first fence guide 50 to make the rip fence 18 and the guiding surface 104 substantially parallel to the blade 22. The further movement of the handle 150 increases the amount of force applied by the self-alignment spring 188 to the first fence guide 50. At the same time, the rod 102, which is pulled by rotation of the activation member 176 towards the left (as illustrated), rotates the lock arm 110 about the pivot pin 108. The spring 128 is compressed against the stop 130 and the projection of the lock arm 110 is pulled into the channel 116 with a sufficient amount of force to lock the projection 112 in the channel 116 of the second fence guide 54 and further engage the lower portion 189 of the glide 181 with the vertical portion of the first fence guide 50 locking rip fence 18 in place. The amount of force applied to the second fence guide 54 can be varied by adjusting the adjustment 122 towards or away from the end 120 of the rod 102 by rotating the adjustment knob 122 about the threads of the rod.

As the handle 150 moves to the locking position in direction 172, the activation member 176 moves via the link 162 and the cam link 164. The activation member 176 moves the spring 188 and the rod 102. The tab 196 engages the first fence guide 50 first, and moves the rip fence 18 to the right (as illustrated) until part of the glide 189 engages with the first fence guide 50 and aligns the rip fence 18 to be substantially parallel to the blade 22 prior to being locked. When the tab 112 engages with the second fence guide 54, a locking force F2 is created which is transferred to the front housing via the guide 100 and creates reaction force Fl. The knob 122 can adjust the locking force F2. The screw 192 can adjust the position of the tab 196 to insure self-alignment prior to the tab 112 engaging the channel 116.

Figure 4:
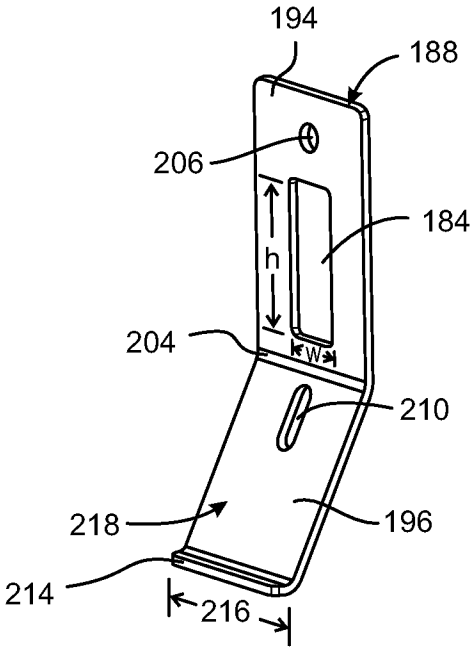
FIG. 4 is perspective view of a locking/self-alignment biasing element.

FIG. 4 illustrates a perspective view of the locking self-alignment spring 188. When viewed face on in a plan view, the locking self-alignment spring defines a substantially rectangular outline having a height larger than the width. Other sizes and shapes of the locking self-alignment spring 188 are, however, possible. The locking self-alignment spring 188 includes the top portion 194 coupled to a bottom portion 196 at a bend 204, or hinge line, which defines an obtuse angle between the top portion 194 and the bottom portion 196. The top portion 194 is coupled to the activation member 176, as previously described, with the attachment screw 190 which is threaded through a screw aperture 206 into the threaded aperture of the activation member 176. While the aperture 206 is illustrated as being circular, the aperture 206 can include a slot to enable the locking spring self-alignment 188 to be located at different positions with respect to the activation member 176.

The top portion 194 of the locking self-alignment spring 188 is a passive part of the locking self-alignment spring 188 and moves with movement of the activation member 176. The bottom portion 196 of the locking self-alignment spring 188, however, is an active part of the locking self-alignment spring and moves in the direction of movement of the activation member 176 until the bottom portion 196 contacts the first fence guide 50. At contact, movement of the bottom portion 196 towards the first fence guide 50 is restricted, while the top portion can continue to move with the activation plate member 176. Further movement of the activation member 176 after contact with the first fence guide 50 increases the force applied to the first fence guide 50 by the first lock mechanism 44 and provides a self-aligning feature by pushing the rip fence 18 toward towards the right (as illustrated), till lower portion 189 of glide 181 engages with vertical portion of the first fence guide 50 to make rip fence 18 and guiding surface 104 substantially parallel to blade 22 prior to lock the projection 112 in the channel 116. The increased force is also provided through the rod 102 to the second lock mechanism 48 to secure the rip fence 18 more securely to the fence guides 50 and 54 of table 14.

The aperture 184 is located in the top portion 194 of the locking self-alignment spring 188. The aperture 184 includes a height, h, longer than a width, w, which is sufficiently wide enough to accommodate insertion of the anti-rotation portion 186 of the rod 102 but is sufficiently small enough to insure that the head 185 does not pass through the aperture 184. The height, h, includes a length longer than the side of the anti-rotation portion 186 in contact with the side of the aperture 184 defined by the height. This difference in length enables movement of the head end of the rod 102 within the aperture 184 to accommodate movement of the activation member 176.

The bottom portion 196 of the locking self-alignment spring 188 includes a slot 210 through which the adjustment screw 192 can be inserted to engage a threaded aperture 212 (See FIG. 1) of the activation member 176. By threading the adjustment screw further into or further out of the threaded aperture 212, the angle of the bottom portion 196 with respect to the flat portion 180 of the activation member can be changed. Consequently, adjustment of the adjustment screw 192 and the adjustment knob 122 can provide a customizable fit of the rip fence 18 to the fence guides 50 and 54. In one embodiment, the adjustment screw 192 can be preset and the adjustment knob 122 can be rotated to manage the amount of force applied by the first and second lock mechanisms 44 and 48 to the fence guides 50 and 54. In other embodiments, the adjustment screw 192 can be rotated and the adjustment knob 122 can be preset, or both the adjustment screw 192 and the adjustment knob 122 can be preset or adjusted together. By providing individual and independently adjustable first and second lock mechanisms 44 and 48, dimensional differences which can exist between one table saw and another table saw can be accommodated and provides a self-aligning feature by pushing the rip fence 18 toward towards the right (as illustrated), till lower portion 189 of glide 181 engages with vertical portion of the first fence guide 50 to make rip fence 18 and guiding surface 104 substantially parallel to blade 22 lock the projection 112 in the channel 116.

The bottom portion 196 includes a locking tab 214 which traverses a width 216 of the bottom portion and which extends from a planar surface 218. The intersection of the planar surface 218 with the locking tab 214 provides a groove which engages a portion of the first fence guide 50, typically a portion of the ledge 200. The slot 210 allows for the adjustment screw 192 to be adjusted to a variety of depths with respect to the activation member 176. When properly adjusted, the self-alignment spring 188 provides a self-aligning feature by making the rip fence 18 and the guiding surface 104 substantially parallel to the blade 22 prior to locking the projection 112 in the channel 116. The locking tab 214 engages the ledge 200 of the first fence guide 50 to lock the rip fence 18 to the table saw and prevents rip fence disengagement from the first fence guide 50 if some force is applied to the handle 150 or the housing 152 in an upward direction. Individualized adjustment for a particular table saw is therefore provided including the ability of the rip fence 18 to be accurately aligned in the cutting direction 23 for table saws whose dimensions can vary from one table saw to another table saw due to different adjustment and manufacturing tolerances.

Figure 5:
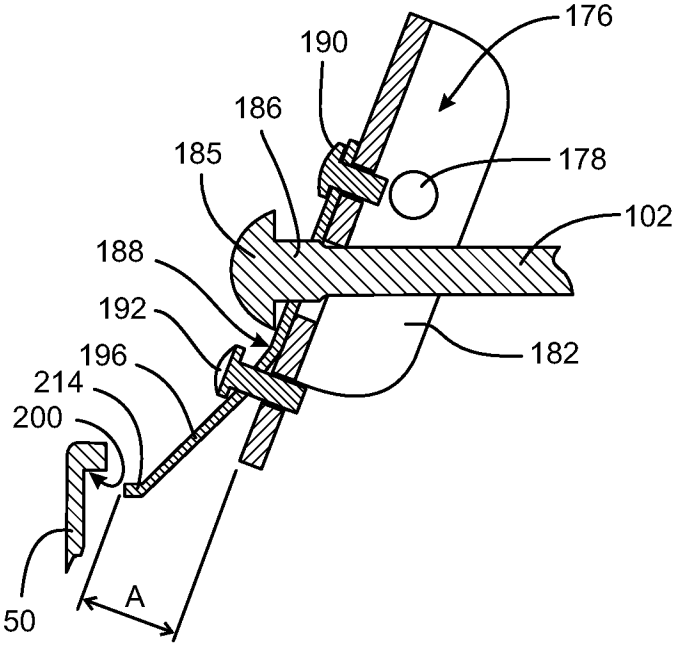
FIG. 5 is a side elevational view of a portion of a locking mechanism including an adjustment mechanism at a first location to adjust the tension of the locking/self-alignment biasing element.

FIG. 5 is a side elevational view of a portion of the first lock mechanism 44 to adjust the tension and position of the locking self-alignment spring 188. The first lock mechanism 44 is adjustable for self-alignment, as previously described, and includes the adjustment screw 192 acting in cooperation with the adjustment screw slot 210 of FIG. 4. A distance, A, between the locking tab 214 and the planar surface 180 of the activation member 176 can be adjusted by rotating the adjustment screw 192 into and out of the activation member. By setting the distance, A, the distance of the locking tab 214 to the ledge 200 can be controlled to enable precise and accurate self-alignment positioning of the rip fence 18 to the table 14.

Figure 6:
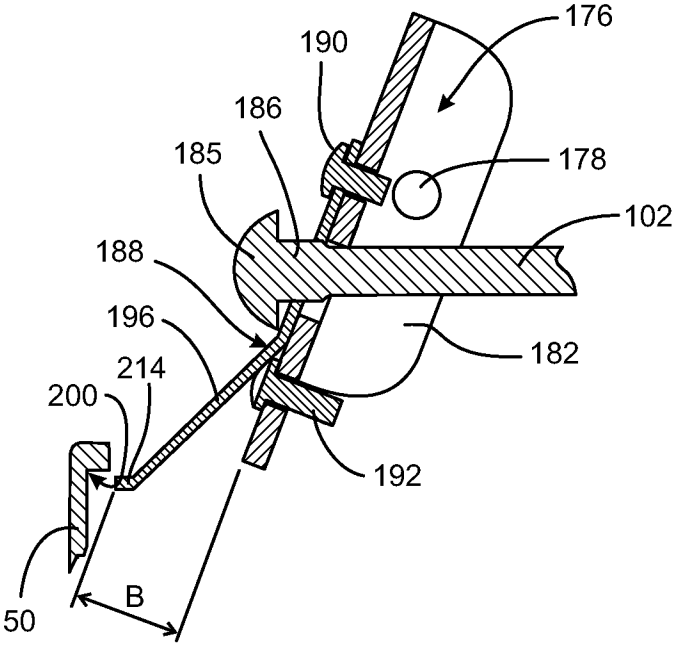
FIG. 6 is a side elevational view of a portion of the locking mechanism including an adjustment mechanism at a second location to adjust the position of the locking/self-alignment biasing element.

FIG. 6 is another embodiment showing a side elevational view of a portion of the first lock mechanism 44 including the adjustment feature of FIG. 5. In FIG. 6, the adjustment screw 192 is placed between the bottom portion 196 of the locking spring 188 and the flat portion 180 of the activation member 176. In this position, the adjustment screw 192 can be rotated into and out of the activation member 176 to adjust the distance, B. In this embodiment, the distance, B, can be made larger than the distance, A, of FIG. 5. Because the adjustment screw can be located either between the activation member 176 and the locking self-alignment spring 188 or inserted through the locking self-alignment spring 188, the first lock mechanism 44 can provide a wide range of adjustability. By providing variable adjustability of the locking mechanism, accurate and secure self-alignment placement of the rip fence 18 to the table 14 can be achieved. The required force needed to maintain the location of the rip fence with respect to the table can also achieved.

The described embodiments include a rip fence having a first and a second lock mechanism, each of which includes an adjustment mechanism to independently adjust one adjustment mechanism for self-alignment with respect to the other adjustment mechanism for locking force. Because the adjustment mechanisms are independent, the impact of dimensional differences between assembled parts can be reduced or overcome while still maintaining the effectiveness of the self-alignment and lock mechanisms. For instance, the locking self-alignment spring 188 provides an alignment feature to enable self-alignment of the spring 188 to the first fence guide 50, and to therefore provide for optimum alignment of the rip fence 18 with respect to the blade 22 and table 14.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A guide assembly for aligning a workpiece on a table of a saw device, comprising:

an alignment member having a first end and a second end;

a first lock mechanism located at the first end of the alignment member and configured to secure the first end to the saw device, the first lock mechanism including (i) an activation member that is pivotable between a locked position and a unlocked position and (ii) a self-alignment biasing element (a) having a passive portion fixedly attached to the activation member and (b) configured to be moved into engagement with the saw device via conjoint rotation with the activation member when the activation member is in the locked position;

a second lock mechanism located at the second end of the alignment member and configured to secure the second end to the saw device, the second lock mechanism being adjustable to apply an adjustable clamping force to the saw device;

a linkage operably coupled to the first lock mechanism and to the second lock mechanism, wherein movement of the first lock mechanism causes the linkage to move the second lock mechanism into engagement with the saw device to secure the first and second ends to the saw device; and a positioner operatively coupled to the self-alignment biasing element, the positioner including an adjustment feature configured to adjust a position of an active portion of the self-alignment biasing element with respect to an engagement portion of the saw device, wherein the active portion is positionable in a first position and a second position with respect relative to the activation member by bending the self-alignment biasing element via the adjustment feature while spaced apart from the engagement portion, wherein, when the active portion of the self-alignment biasing element is in the first position and the activation member is in the locked position, the self-alignment biasing element is configured to apply a first self-alignment force to the saw device, and wherein, when the active portion of the self-alignment biasing element is in the second position and the activation member is in the locked position, the self-alignment biasing element is configured to apply a second self-alignment force to the saw device, the second self-alignment force being different than the first self-alignment force.

2. The guide assembly of claim 1 wherein the first lock mechanism is independently adjustable with respect to the second lock mechanism.

3. The guide assembly of claim 2 wherein the first lock mechanism includes a handle operatively coupled to the activation member to move the activation member and the self-alignment biasing element toward a front guide.

4. The guide assembly of claim 3 wherein the second lock mechanism includes a lock arm operatively coupled to the linkage and movement of the linkage moves the lock arm toward a rear guide to secure the second end to the saw device.

5. The guide assembly of claim 4 wherein the linkage includes a rod operatively coupled to the lock arm and an adjustment knob operatively coupled to an end of the rod, the adjustment knob being adjustable with respect to the rod to vary a force applied by the lock arm to secure the first and second ends to the saw device.

6. The guide assembly of claim 5 wherein the self-alignment biasing element is formed as part of the activation member.

7. The guide assembly of claim 5 wherein the self-alignment biasing element is separable from the activation member.

8. The guide assembly of claim 5 wherein the activation member includes a surface, a portion of which is spaced from the self-alignment biasing element and the positioner is configured to be adjusted to increase or decrease the space between the surface and the self-alignment biasing element.

9. A power saw comprising:

a blade;

a table including an opening configured to receive the blade; and an alignment member provided on the table, the alignment member having a first lock mechanism located at a first end of the alignment member and a second lock mechanism located at a second end of the alignment member, wherein the first lock mechanism includes (i) an activation member that is pivotable between a locked position and a unlocked position, (ii) a self-alignment biasing element (a) having a passive portion fixedly attached to the activation member and (b) configured to be moved into engagement with the table via conjoint rotation with the activation member when the activation member is in the locked position, and (iii) a positioner operatively coupled to the self-alignment biasing element, the positioner including an adiustment feature configured to adjust a position of an active portion of the self-alignment biasing element with respect to an engagement portion of the table, wherein the second lock mechanism is adjustable to apply an adjustable clamping force to the table, wherein the active portion is positionable in a first position and a second position with respect relative to the activation member by bending the self-alignment biasing element via the adjustment feature while spaced apart from the engagement portion, wherein, when the active portion of the self-alignment biasing element is in the first position and the activation member is in the locked position, the self-alignment biasing element is configured to apply a first self-alignment force to the table, and wherein, when the active portion of the self-alignment element is in the second position and the activation member is in the locked position, the self-alignment biasing element is configured to apply a second self-alignment force to the table, the second self-alignment force being different than the first self-alignment force.

10. The power saw of claim 9 further comprising a linkage operably connected to the first lock mechanism and to the second lock mechanism, wherein movement of the first lock mechanism causes the linkage to move the second lock mechanism into engagement with a rear guide to secure the second end of the alignment member to the rear guide and the first end of the alignment member to a front guide.

11. The power saw of claim 10 wherein the first lock mechanism is independently adjustable with respect to the second lock mechanism.

12. The power saw of claim 11 wherein the first lock mechanism includes a handle operatively coupled to the activation member to move the activation member and the attached self-alignment biasing element toward the front guide.

13. The power saw of claim 12 wherein the second lock mechanism includes a lock arm operatively coupled to the linkage and movement of the linkage moves the lock arm toward the rear guide to secure the second end of the alignment member to the rear guide and the first end of the alignment member to the front guide.

14. The power saw of claim 13 wherein the linkage includes a rod operatively coupled to the lock arm and an adjustment knob operatively coupled to an end of the rod, the adjustment knob being adjustable with respect to the rod to vary a force applied by the lock arm to secure the second end of the alignment member to the rear guide and the first end of the alignment member to the front guide.

15. The power saw of claim 14 wherein the activation member includes a surface, a portion of which is spaced from the self-alignment biasing element, the positioner being adjustable to increase or decrease a space between the surface and the self-alignment biasing element.

16. The power saw of claim 15 wherein the front guide is disposed substantially perpendicular to a cutting direction of the blade and the self-alignment biasing element is compressed to secure the first end to the front guide.

17. The power saw of claim 16 wherein a portion of the front guide defines the engagement portion as a ledge and the self-alignment biasing element includes a tab and the tab engages the ledge when the first end is secured to the front guide.

18. The power saw of claim 17, wherein the tab includes a groove configured to engage the ledge, the groove providing an alignment feature to align the alignment member substantially parallel to the cutting direction of the blade when the first end is secured to the front guide.

* * * * *